US006485226B1

(12) United States Patent
Harger

(10) Patent No.: US 6,485,226 B1
(45) Date of Patent: Nov. 26, 2002

(54) FLEXIBLE PLASTIC CURB

(76) Inventor: Bill A. Harger, 17590 Clydesdale Rd., Colorado Springs, CO (US) 80908

( * ) Notice: Subject to any disclaimer, the term of this patent is extended or adjusted under 35 U.S.C. 154(b) by 0 days.

(21) Appl. No.: 10/124,018

(22) Filed: Apr. 18, 2002

(51) Int. Cl.[7] ..... E01C 11/22; E01F 9/04
(52) U.S. Cl. ..... 404/7; 404/10; 404/11
(58) Field of Search ..... 404/2, 4, 6, 7, 404/8, 9, 10, 11, 72, 73, 18

(56) References Cited

U.S. PATENT DOCUMENTS 3,957,383 A * 5/1976 Fredericks ..... 404/72
4,863,307 A * 9/1989 Jones ..... 404/7
5,217,319 A * 6/1993 Klohn ..... 340/407.1
5,377,447 A * 1/1995 Fritch ..... 404/7
5,640,801 A * 6/1997 Rynberk ..... 404/7
5,694,723 A * 12/1997 Parker ..... 404/4
5,769,562 A * 6/1998 Jones ..... 404/7
5,771,643 A * 6/1998 Parker ..... 404/8
6,030,144 A * 2/2000 Cannella ..... 404/7
6,099,201 A * 8/2000 Abbrancati ..... 404/4
6,379,078 B1 * 4/2002 Zwier ..... 404/4

* cited by examiner

*Primary Examiner*—Thomas B. Will
*Assistant Examiner*—Alexandra K. Pechhold
(74) *Attorney, Agent, or Firm*—G. F. Gallinger

(57) ABSTRACT

A method of employing a safe and effective flexible plastic curb and gutter. The method of installing a curb along the side of a road having a lower layer prior to laying a top layer of asphalt on the road comprises providing elongated curb strips each having i) a horizontal holding side portion having spaced openings cut therealong; and, ii) a uniformly continuous upright trough portion having a lower edge portion continuously attached to the outer edge of the horizontal side portion. An upper edge portion of the upright trough portion is adapted to extend above the upper layer of asphalt so that water running off the road is channelled along an inner side of the upright trough portion. The horizontal holding side portion of the elongated strip is seated along and parallel to an outside edge portion of the lower layer so when the top layer of asphalt is laid thereon adhesion between the layers through the openings therethrough hold the elongate curb strip in position.

12 Claims, 2 Drawing Sheets

FLEXIBLE PLASTIC CURB

FIELD OF THE INVENTION

This invention relates to a safe and effective plastic curb and gutter which is advantageously employed along the side of public roadways as well as on trails and gardens on private property. More particularly this invention relates to a flexible plastic curb and gutter which is extremely unlikely to contribute to a vehicle overturning or becoming airborne. The invention discloses a design which is inexpensive to instal and is particularly effective as a water channelling and erosion reducing device. It has particular advantage on sloped and curved roadways having a guard rail.

BACKGROUND OF THE INVENTION

The applicants own and operate a company which instals concrete curbs and gutters along the side of public roadways. The installation of concrete curbs and gutters is time consuming. Concrete curbs are machine formed or hand formed, poured, finished, and then stripped of the forms. The demand for concrete curbs and asphalt erosion control curbs is falling substantially. Statistics have implicated concrete curbs as a contributing cause of many serious accidents. When a vehicle's wheels hit a curb, the vehicle's wheels are thrust into the air causing loss of control and possibly even vehicle overturn. The vehicle, out of control, is then likely to be hit by other vehicles. A large percentage of all vehicle rollovers are caused when motorists drive off roads onto soft shoulders and then attempt to re-enter traffic. A safer curb is needed.

In the mountainous regions of Colorado there are many roads which slope and have curves and guardrail running along the curved portion of the roadway. Typically the guard rail is supported in an elevated position by an upright steel or wood member. To protect the gravel between and around the upright members from erosion, concrete or asphalt curbs and now recently wooden boards are anchored to and between the upright members immediately above the ground. Attaching the wooden boards to the upright members is difficult. The boards then become a high maintenance item, not to mention a waste of natural resources. And most notably they are minimally effective in preventing erosion. Along a stretch of inclined roadway a substantial volume of water may run off, and stream along beside the roadway. Where the road curves the boards attempt to turn this stream of water. First there is a problem with wash over and under the boards. Then there is a problem with erosion undermining the gravel within which the upright members are anchored. An enormous amount of money has been spent, and much money is expended annually on restoring eroded guardrail support, shoulder material and asphalt breakage on roadways. But no durably satisfactory solution to this long standing problem has been found.

OBJECTS OF THE INVENTION

It is an object of this invention to disclose a safe curb and gutter which is substantially less likely to overturn a vehicle when its wheels strike the curb. It is yet a further object of this invention to disclose a curb and gutter which is very effective as a gutter in handling large volumes of runoff water streaming down along beside a curving road. It is yet a further object of this invention to disclose a curb which will improve road safety by reducing erosion along roads. It is yet a further object of this invention to reduce road maintenance required by damage to curbs caused by snow ploughs. It is yet a further object of this invention to significantly reduce the cost of material and installation labor expended in the installation of curbs. The installation cost of the disclosed curbs under guard rails may can be less than one tenth of the conventional cost of such installations. And these curbs will be substantially more effective and require substantially less maintenance. It is yet a further object of this invention to disclose a curb which is substantially more durable and maintenance free than conventional curbs. It is estimated that the disclosed curbs will have a life and durability which triples that of conventional concrete or asphalt curbs. It is yet a final object of this invention to eliminate the steps of painting and maintaining a mark indicating the edge of a road.

One aspect of this invention provides for a method of installing a curb along side of a road having a lower layer prior to laying a top layer of asphalt on the road comprising comprising the following steps. a) Providing elongated curb strips each having i) a generally horizontal lower holding side portion having spaced openings cut therealong, said lower holding side portion adapted to be seated parallel to the edge of the road on the outer edge portion of the lower layer, and beneath the top layer of asphalt so that the elongated strip is secured in position therebetween by adhesion between the layers through the spaced openings therealong; and, ii) a uniformly continuous and unbroken upright trough portion having a lower edge portion continuously attached to the outer edge of the generally horizontal side portion, and an upper edge portion adapted to extend above the top layer of asphalt so that water running off the road is channelled along an inner side of the upright trough portion parallel to the edge of the road. b) Positioning the elongated strips end to end, each along and attached to an outer side of the lower layer so that the upright portion of each strip extends upwardly above and outwardly away from the outer side of the lower layer. And finally, c) laying the top layer of asphalt generally above and on the lower layer thereby permanently securing the elongated strips in position by adhesion between the layers through the openings in the generally horizontal holding side portions of the elongated strips. Water running off the road will be channelled along an inner side portion of the continuous and unbroken upright trough portions of the elongated strips.

A preferred method of the invention further comprises the step of attaching the strips 20 to the lower layer 18 prior to laying the top layer of asphalt 16. In yet another embodiment of the invention the method comprises providing a curb strip as above which has a continuous descending side portion having an inner edge portion continuously attached to the outer edge portion of the upright trough portion. The upright trough portion and the descending portion together form a rounded portion which flattens under force.

Various other objects, advantages and features of this invention will become apparent to those skilled in the art from the following description in conjunction with the accompanying drawings.

FIGURES OF THE INVENTION

FIG. 1 is a perspective view of elongated strips of curb installed on a lower layer of a road prior to laying the top layer of asphalt on and above the lower layer.

FIG. 2 is a cross sectional view of the road and the elongate strip of curb as viewed along line 2—2 on FIG. 1. FIG. 2 shows the top layer of asphalt being positioned on and above the lower layer. FIG. 2 also shows the elongate strip flexes when it is impacted.

Figure 1:
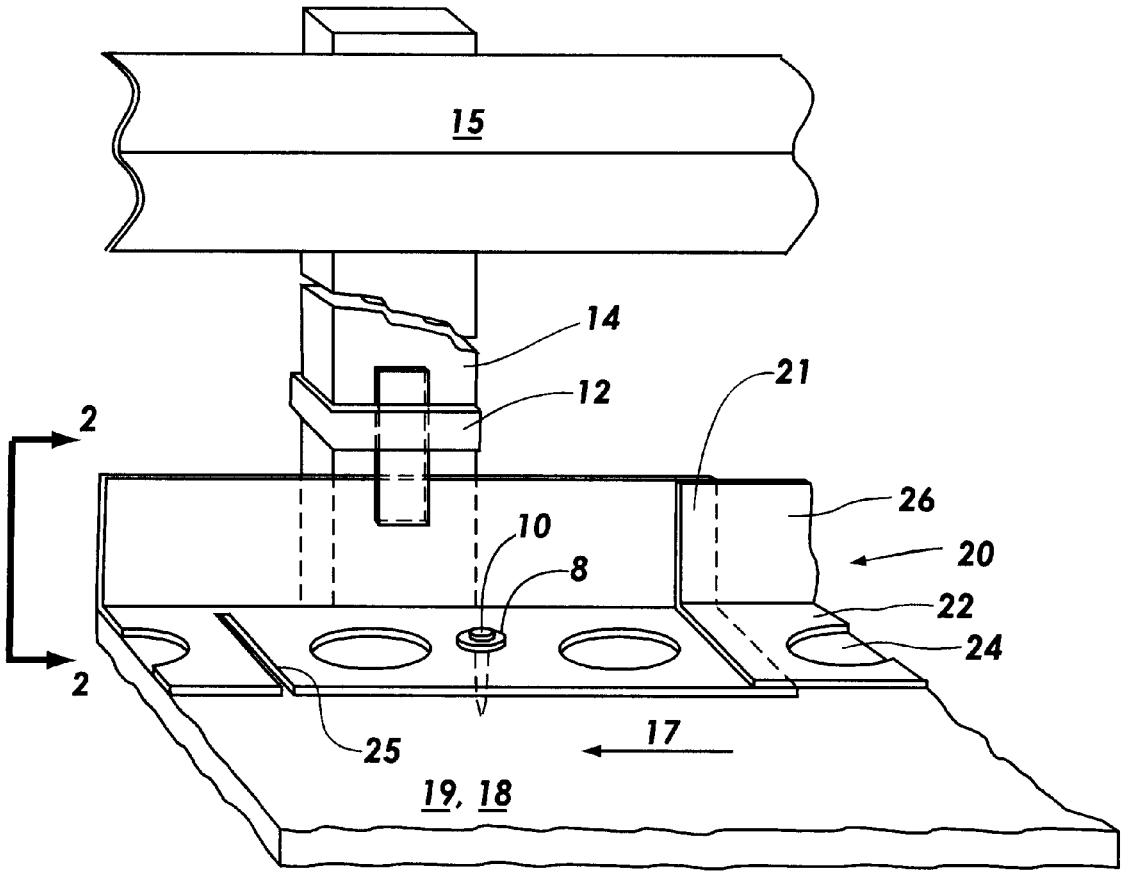

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
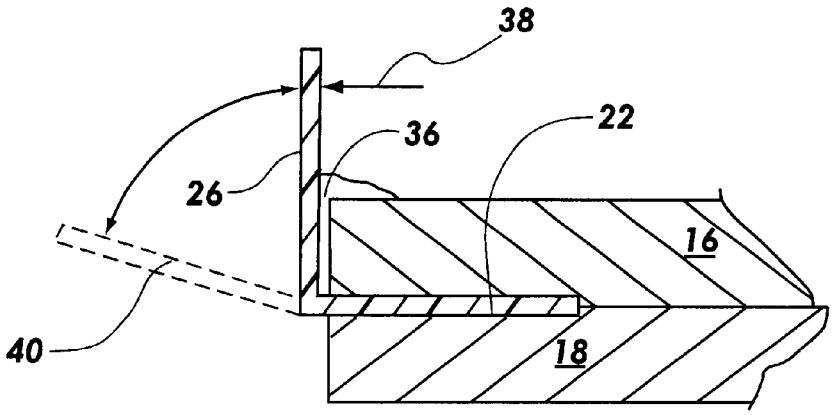

Turning now to the drawings and more particularly to FIG. 1 we have a perspective view of elongated strips of curb 20 installed on a lower layer 18 of a road 19 prior to laying the top layer of asphalt 16 on and above the lower layer 18. It is intended that such lower layer 18 of the road would include any material which a top layer of pavement 16 might be laid on. For example, such lower layer 18 might be a gravel road base in a golf course, a first or second layer of pavement in a new road, or an uppermost layer in an existing road which is to be resurfaced with the top layer of asphalt 16. FIG. 2 is a cross sectional view of the road 19 and strip of curb 20 showing how the top layer of asphalt 16 is positioned. A method of installing a strip of curb 20 along side of a paved road 19 having a lower layer 18 and a top layer of asphalt 16 comprises the following steps. a) Providing elongated strips of curb 20 having i) a generally horizontal lower holding side portion 22 having spaced openings 24 cut therealong, said lower holding side portion 22 adapted to be seated parallel to the edge of the road 19 on the outer edge portion of the lower layer 18, and beneath the top layer of asphalt 16 so that the elongated strip 20 is secured in position therebetween by adhesion between the layers 18,16 through the spaced openings 24 cut therealong; and, ii) a uniformly continuous and unbroken upright trough portion 26 having a lower edge portion continuously attached to the outer edge of the generally horizontal lower holding side portion 22, and an upper edge portion adapted to extend above the top layer of asphalt 16 so that water 36 running off the road 19 is channelled along an inner side of the upright trough portion 26 parallel to the edge of the road 19.

The second step, b) step of the method comprises positioning the provided elongated strips 20 end to end, each along an outer side of the road 19 and lower layer 18 so that the upright portion 26 of each strip 20 extends upwardly above the outer side of the lower layer. The final, c) step of the method comprises laying the top layer of asphalt 16 generally above and on the lower layer 18 thereby permanently securing the elongated strips 20 in position by adhesion between the layers 18,16 through the openings 24 cut in the generally horizontal holding side portions 22 of the elongated strips 20. Water 36 running off the road 19 will then be channelled along an inner side portion of the continuous and unbroken upright trough portions 26 of the elongated strips 20.

FIG. 2 is a cross sectional view of the road and the elongate strip of curb as viewed along line 2—2 on FIG. 1. FIG. 2 best shows how the elongate strip of curb 20 flexes when it is impacted by a force 38 caused by wheels on a vehicle (not shown) or a blade on a snow plough (not shown). Most preferably the elongated strips 20 are extruded from a rigid, flexible, and resilient, plastic sufficiently rigid to channel water 36; sufficiently flexible to bend over to a generally flat position 40 when impacted 38 ; and sufficiently resilient to recover pre-impact shape thereafter. When the elongated strips 20 are extruded then the openings 24 therethrough are cut after extrusion.

Most preferably the elongated strips 20 are held in position prior to laying the upper layer of asphalt 16 by nails 10 and washers 9. It is contemplated that the elongated strips 20 could alternatively be attached by screws or glue. (neither shown) If the road 19 curves, it normally has a guard rail 15 supported by an upright member 14. Then the method further comprises the step of attaching, most preferably by clamping 12 the upright trough portion 26 of the elongate members 20 to the upright supporting member 14 of the guard rail.

When the road 19 slopes upwardly the end portions of the elongated strips 20 are overlapped with the end of the generally higher elongated strip 20 on and within the end portion of the generally lower elongated strip 20 so that water running along the road 17 will be conveyed from within the generally upper to the generally lower elongated strip.

For common applications where the road 19 does not curve sharply the openings 24 in the lower holding side portion 22 of the elongated strips 20 are cut wholly within and surrounded by said horizontal lower holding side portion 22 of the strip 24. If the road 19 curves sharply then some openings 25 in the lower holding side portion 22 of the strip 20 may extend from an inner edge portion of the generally horizontal lower holding side portion 22 generally across a width of the lower holding side portion 22 of the strip 20 so the strip 20 may be laterally bent to conform to the sharp curve in the road 19.

Figure 3:
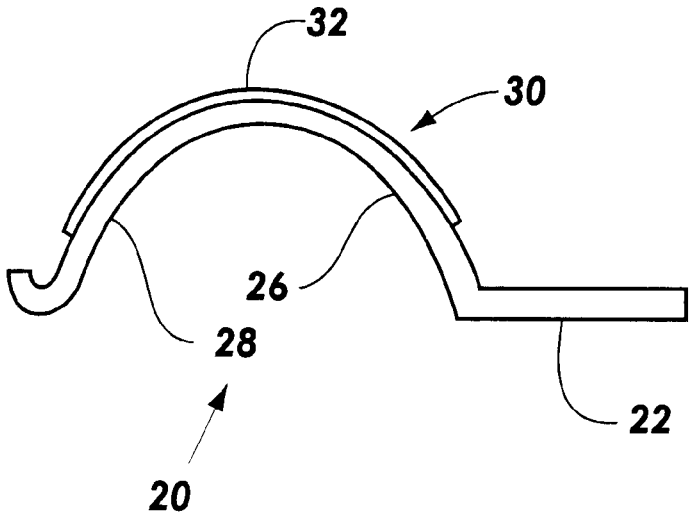
FIG. 3 is a cross sectional embodiment of yet another embodiment of a strip of flexible curb having a descending side portion attached to and descending from the upright trough portion. The upright trough portion and the descending side portion together form a rounded portion which flattens when driven over.

FIG. 3 is a cross sectional embodiment of yet another embodiment of a strip of flexible curb 20 having a descending side portion 28 attached to and descending from the upright side portion 26. The upright trough portion 26 and the descending side portion 28 together form a rounded portion 30 which flattens when driven over. Like the upright trough portion 26 the descending side portion 28 is continuous. The descending side portion 28 has an inner edge portion which is continuously attached to the outer edge portion of the upright trough portion 26. The upright trough portion 26 and the descending portion 28 together form a rounded portion 30 which flattens when driven over. A colored reflective coating 32 covering a top portion of the rounded portion 30 may be used to mark the edge of the road 19 for motorists. This colored reflective coating 32 would eliminate regularly painting the edge of the road 19 after the top layer of asphalt 16 had been laid.

Figure 4:
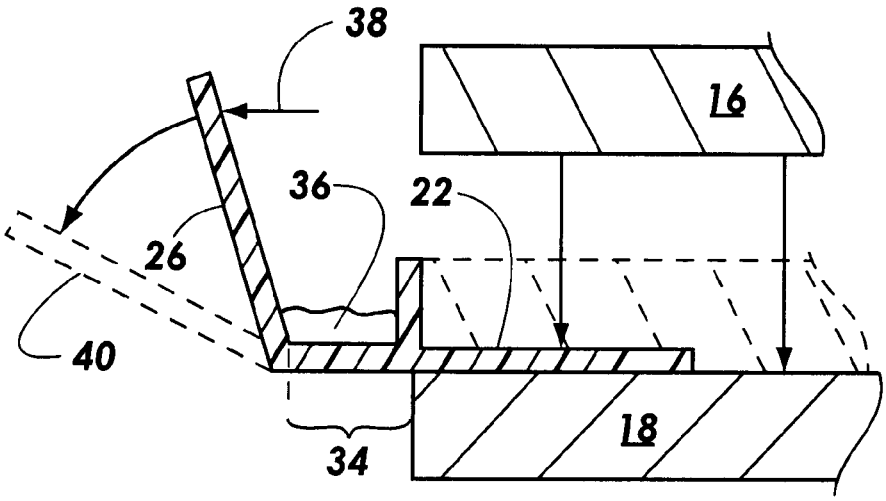
FIG. 4 is a cross sectional view of an alternate embodiment of an elongate strip of curb installed above a lower layer prior to laying the top layer of asphalt on and above the lower layer.

FIG. 4 is a cross sectional view of an alternate embodiment of an elongate strip of curb 20 installed above a lower layer 18 prior to laying the upper layer of asphalt 16 on and above the lower layer 18. The generally horizontal lower side portion 22 is extra wide. The elongated strip 20 is installed above and extends an extra width 34 outwardly beyond the lower layer 18 to thereby form a water trough 36 beside the top layer of asphalt 16 and provide an extra width 36 of the curb for flexing when the upright trough portion 26 is struck down.

It is contemplated that for public roads 19 the upright trough portion 26 of the elongate curb strip 20 will have a vertical height of generally 5 inches. Layers of asphalt 16, 18 are generally 2 inches in depth, so that a 6 inch upright trough portion would thereby extend generally 4 inches above the top side portion of the top layer of asphalt 16. It is contemplated that elongate curb strips 20 would also have application in private landscaping and along golf roads 19 (or pathways). In landscaping applications it is further contemplated that a top portion of the upright trough portions could be adapted to accommodate holding rope lights. (not shown)

It is anticipated that the method of the invention would first be employed on curving road under guard rail where current methods are enormously expensive both in installation and maintenance costs. It is anticipated that other applications on public roads 19 would be motivated more by safety considerations than by cost considerations which here too are substantial.

While the invention has been described with preferred specific embodiments thereof, it will be understood that this description is intended to illustrate and not to limit the scope of the invention, which is defined by the following claims.

I claim:

1. A method of installing a curb along side of a road having a lower layer prior to laying a top layer of asphalt on the road comprising the following steps:

a) providing elongated curb strips each having
   i) a generally horizontal lower holding side portion having spaced openings therealong, said lower holding side portion adapted to be seated parallel to the edge of the road on the outer edge portion of the lower layer, and beneath the top layer of asphalt so that the elongated strip is secured in position therebetween by adhesion between the layers through the spaced openings therealong; and,
   ii) a uniformly continuous and unbroken upright trough portion having a lower edge portion continuously attached to the outer edge of the generally horizontal side portion, and an upper edge portion adapted to extend above the top layer of asphalt so that water running off the road is channelled along an inner side of the upright trough portion parallel to the edge of the road;

b) positioning the elongated strips end to end, each along an outer side of the lower layer so that the upright portion of each strip extends upwardly above the outer side of the lower layer; and, c) laying the top layer of asphalt generally above and on the lower layer thereby permanently securing the elongated strips in position by adhesion between the layers through the openings in the generally horizontal holding side portions of the elongated strips; so that water running off the road will be channelled along an inner side portion of the continuous and unbroken upright trough portions of the elongated strips.

2. A method as in claim 1 wherein the elongated strips are extruded from a rigid, flexible, and resilient, plastic and wherein the openings are cut through the generally horizontal side portions of the elongated strips.

3. A method as in claim 2 further comprising the step of attaching the elongated strips to the lower layer to hold them in position prior to laying the top layer of asphalt.

4. A method as in claim 2 wherein the road curves and has a guard rail having an upright supporting member and further comprises the step of attaching the upright trough portion of the elongate members to the upright supporting member of the guard rail.

5. A method as in claim 4 wherein the upright trough portion of the elongate curb strip is clamped to the upright supporting member.

6. A method as in claim 2 wherein the road slopes upwardly and wherein the end portions of the elongated strips are overlapped with the end of the generally higher elongated strip on and within the end portion of the generally lower elongated strip so that water running down along the road will be conveyed from within the generally upper to the generally lower elongated strip.

7. A method as in claim 2 wherein the openings in the lower holding side portion of the elongated strips are cut wholly within and surrounded by said horizontal lower holding side portion of the strip.

8. A method as in claim 2 wherein openings in the lower holding side portion of the strip extend from an inner edge portion of the generally horizontal lower holding side portion generally across a width of the lower holding side portion of the strip so the strip may be laterally bent to conform to a curve in the road.

9. A method as in claim 2 wherein the elongated strips further comprise a continuous descending side portion having an inner edge portion continuously attached to the outer edge portion of the upright trough portion.

10. A method as in claim 9 wherein the upright trough portion and the descending portion together form a rounded portion which flattens under force.

11. A method as in claim 10 further comprising a colored reflective coating covering a top portion of the rounded portion to mark the edge of the road for motorists.

12. A method as in claim 2 wherein the generally horizontal lower side portion is extra wide and wherein the elongated strip is installed above and outwardly extending an extra width outwardly beyond the lower layer to thereby form a water trough beside the top layer of asphalt and provide an extra width of the curb for flexing when the curb is struck down.

* * * * *

UNITED STATES PATENT AND TRADEMARK OFFICE

CERTIFICATE OF CORRECTION

PATENT NO. : 6,485,226 B1 
DATED : November 26, 2002
INVENTOR(S) : Mark A. Harger and Bill A. Harger It is certified that error appears in the above-identified patent and that said Letters Patent is hereby corrected as shown below:

Title page,
Item [76], should read:
-- Mark A. Harger (6581 Sproul Ln., Colorado Springs, CO 80918)
Bill A. Harger (17590 Clydesdale Rd., Colorado Springs, CO 80908) --

Signed and Sealed this

Third Day of June, 2003

JAMES E. ROGAN
*Director of the United States Patent and Trademark Office*